US009900941B2

(12) United States Patent
Huang et al.

(10) Patent No.: US 9,900,941 B2
(45) Date of Patent: Feb. 20, 2018

(54) RIPPLE SUPPRESSION CIRCUIT, SUPPRESSION METHOD AND LED LIGHTING APPARATUS

(71) Applicant: Silergy Semiconductor Technology (Hangzhou) LTD, Hangzhou, ZheJiang Province (CN)

(72) Inventors: Qiukai Huang, Hangzhou (CN); Jian Deng, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 15/368,802

(22) Filed: Dec. 5, 2016

(65) Prior Publication Data

US 2017/0181234 A1 Jun. 22, 2017

(30) Foreign Application Priority Data

Dec. 22, 2015 (CN) ..... 2015 1 0980124

(51) Int. Cl.
*H05B 33/08* (2006.01)
*H05B 41/28* (2006.01)
*G05F 1/56* (2006.01)

(52) U.S. Cl.
CPC ..... *H05B 33/0815* (2013.01); *G05F 1/56* (2013.01)

(58) Field of Classification Search
None
See application file for complete search history.

(56) References Cited

U.S. PATENT DOCUMENTS

| | | | | |
|---|---|---|---|---|
| 8,164,275 | B2 | 4/2012 | Doudousakis et al. | |
| 9,301,352 | B2 | 3/2016 | Zhu | |
| 9,429,970 | B2 | 8/2016 | Kuang et al. | |
| 2014/0176017 | A1* | 6/2014 | Kuang | H05B 33/0824 315/307 |
| 2015/0381054 | A1* | 12/2015 | Chang | H02M 3/33507 315/294 |

FOREIGN PATENT DOCUMENTS

CN 103813596 A 5/2014

* cited by examiner

*Primary Examiner* — Dedei K Hammond
(74) *Attorney, Agent, or Firm* — Michael C. Stephens, Jr.

(57) ABSTRACT

A ripple suppression circuit configured to suppress a current ripple provided to a load by a DC converter, can include: a ripple voltage sampling circuit coupled to output terminals of the DC converter, where the ripple voltage sampling circuit is configured to generate a ripple reference voltage that represents a ripple voltage of an output voltage of the DC converter; and a voltage regulation circuit coupled to the load and the ripple voltage sampling circuit, where the voltage regulation circuit is controllable by the ripple reference voltage such that a voltage across the voltage regulation circuit is consistent with the ripple voltage.

20 Claims, 7 Drawing Sheets

RIPPLE SUPPRESSION CIRCUIT, SUPPRESSION METHOD AND LED LIGHTING APPARATUS

RELATED APPLICATIONS

This application claims the benefit of Chinese Patent Application No. 201510980124.5, filed on Dec. 22, 2015, which is incorporated herein by reference in its entirety.

FIELD OF THE INVENTION

The present invention generally relates to the field of power electronics, and more particularly to ripple suppression circuits, suppression methods, and associated LED lighting apparatuses.

BACKGROUND

Output signals of a switching power supply configured to drive an LED load generally include ripple components. For example, output current of a switching power supply may include a ripple component of a power frequency or a lower frequency. Thus, the output voltage of the switching power supply may also include such ripple components. When the output signals are directly configured to drive LED load, flicker or stroboscopic effects may occur.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

In many switching power supplies, an electrolytic capacitor of a relatively large capacitance is employed to store energy, and to provide a DC voltage to the LED load, through which the ripple component of the output current can be decreased. However, by this implementation, power factor correction (PFC) may not be achieved, and the service life of electrolytic capacitor can become a large issue as to the lifetime of the system. For such switching power supplies, a PFC circuit can be added in order to improve the power factor, to improve the efficiency and to increase the lifetime of the power supply. For a constant output current topology of a single stage PFC circuit, the power efficiency can be greater than 92%; however, the ripple components (e.g., at the power frequency) of this kind of switching power supply or DC converters of this topology may be substantially high.

Figure 1:
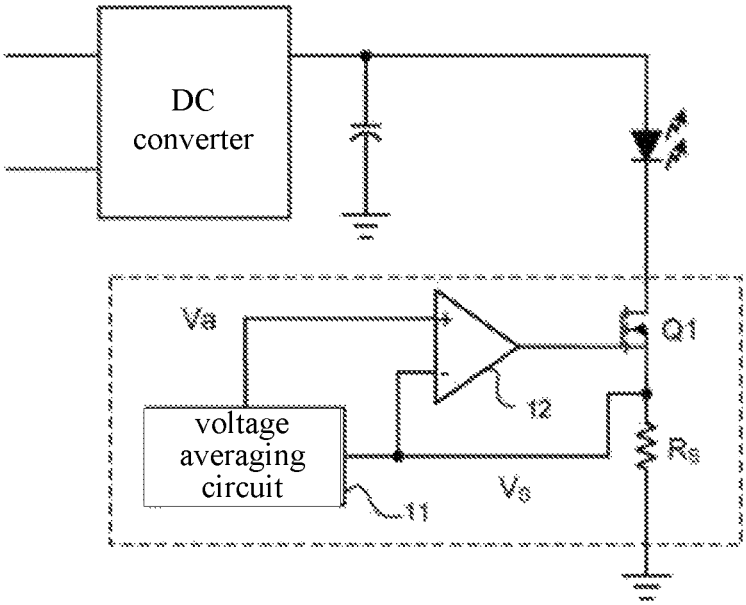
FIG. 1 is a schematic block diagram of an example ripple suppression circuit.

Referring now to FIG. 1, shown is a schematic block diagram of an example ripple suppression circuit. This example ripple suppression circuit can include transistor Q1 and resistor Rs coupled in series between the negative terminal of the LED load and the ground terminal, voltage averaging circuit 11, and error amplifier 12. The drain of transistor Q1 can connect to the negative terminal of LED load, the source of transistor Q1 can connect to resistor Rs, and the gate of transistor Q1 can connect to the output of error amplifier 12. The inverting input terminal of error amplifier 12 can connect to a common node between transistor Q1 and resistor Rs, that is source of transistor Q1. Voltage averaging circuit 11 can connect between the inverting and non-inverting input terminals of error amplifier 12, and can generate an average voltage of the voltage at the inverting terminal that may be provided to the non-inverting input terminal. For example, voltage averaging circuit 11 can be a low-pass filter circuit.

Because driving current $I_{LED}$ that flows through the LED load also flows through resistor Rs, voltage Vs at the common node between resistor Rs and transistor Q1 may vary along with driving current $I_{LED}$. Voltage Vs can be averaged by voltage averaging circuit 11 in order to generate voltage Va. Voltage Vs may be provided to the inverting input terminal of error amplifier 12, and voltage Va can be provided to the non-inverting input terminal of error amplifier 12. Therefore, the output voltage of error amplifier 12 may vary along with the error between voltages Vs and Va. Error between voltages Vs and Va can represent the ripple component of driving current $I_{LED}$. The gate of transistor Q1 may be driven by the output voltage of error amplifier 12 to operate in a linear mode; therefore, driving current $I_{LED}$ can be correspondingly regulated such that the error between voltage Vs and voltage Va is substantially zero. However, when driving current $I_{LED}$ is reduced, the average current of driving current $I_{LED}$ may not be correctly obtained, which may not eliminate the influence to the LED load due to ripple components.

In one embodiment, a ripple suppression circuit configured to suppress a current ripple provided to a load by a DC converter, can include: (i) a ripple voltage sampling circuit coupled to output terminals of the DC converter, where the ripple voltage sampling circuit is configured to generate a ripple reference voltage that represents a ripple voltage of an output voltage of the DC converter; and (ii) a voltage regulation circuit coupled to the load and the ripple voltage sampling circuit, where the voltage regulation circuit is controllable by the ripple reference voltage such that a voltage across the voltage regulation circuit is consistent with the ripple voltage.

In one embodiment, a ripple suppression method configured to suppress a current ripple provided to a load by a DC converter, can include: (i) generating a ripple reference voltage representing a ripple voltage of an output voltage of the DC converter; and (ii) controlling a voltage across a voltage regulation circuit coupled in series with the load between the output terminals of the DC converter to be consistent with the ripple voltage in accordance with the ripple reference voltage.

Figure 2:
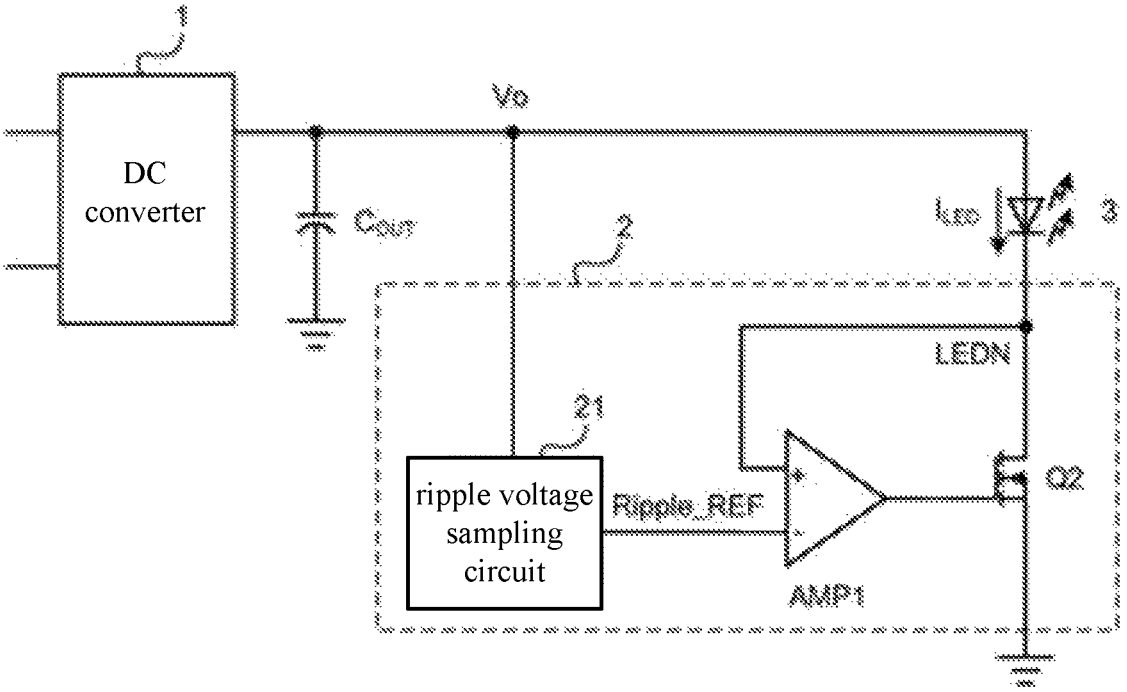
FIG. 2 is a schematic block diagram of an example LED driving circuit having a ripple suppression circuit, in accordance with embodiments of the present invention.

Referring now to FIG. 2, shown is a schematic block diagram of an example LED driving circuit having a ripple suppression circuit, in accordance with embodiments of the present invention. This particular example LED driving circuit can include DC converter 1, output filter capacitor Cout, and ripple suppression circuit 2, which is configured to drive LED load 3. DC converter 1 can achieve power conversion and power factor correction (PFC) performance. Output filter capacitor Cout can filter the output voltage of DC converter 1. Ripple suppression circuit 2 may suppress or substantially eliminate the current ripple provided to the LED load by DC converter 1. Ripple suppression circuit 2 can include transistor Q2, ripple voltage sampling circuit 21, and error amplifier AMP1.

Transistor Q2 can connect between LED load 3 and the ground terminal. Ripple voltage sampling circuit 21 can connect to the output terminal of DC converter 1, and may generate ripple reference voltage Ripple_REF in accordance with output voltage Vo of DC converter 1. The inverting input terminal of error amplifier AMP1 may receive ripple reference voltage Ripple_REF, the non-inverting input terminal can connect to common node LEDN (e.g., the negative terminal of the LED load) between transistor Q2 and LED load 23, and the output terminal can connect to the gate of transistor Q2. In this example, the non-inverting input terminal of error amplifier AMP1 can connect to the source of transistor Q2.

For example, ripple reference voltage Ripple_REF is a variable voltage signal that represents the ripple component of output voltage Vo. Because ripple reference voltage Ripple_REF may be larger than zero to achieve regulation of transistor Q2, DC reference signal $V_{DC_REF}$ can be added to a sampling signal that represents the ripple component of output voltage Vo. One input terminal of error amplifier AMP1 can receive ripple reference voltage Ripple_REF, and the other input terminal may receive voltage $V_{LEDN}$ at common node LEDN (e.g., the drain voltage of transistor Q2). Source voltage $V_{LEDN}$ of transistor Q2 can be controlled to follow the variation of ripple reference voltage Ripple_REF by the feedback loop configured by error amplifier AMP1 and transistor Q2, which may also follow the variation of the ripple component of output voltage Vo.

Figure 3:
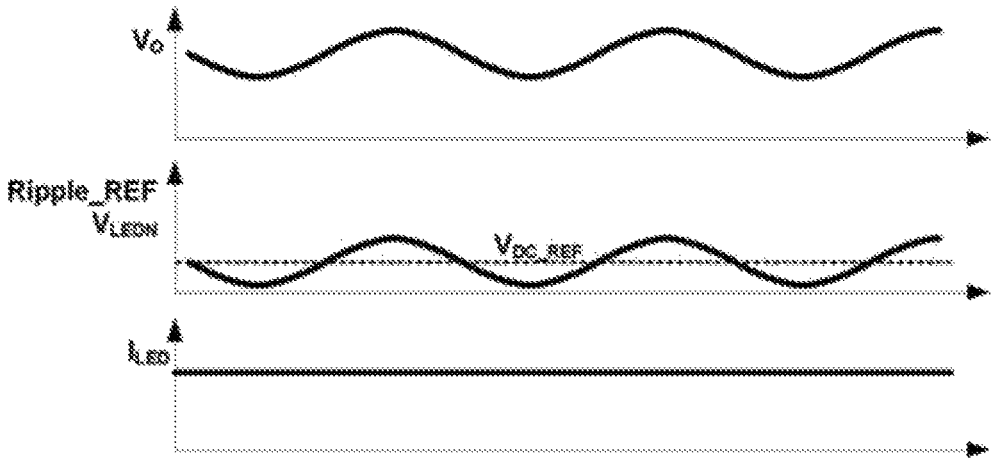
FIG. 3 is a waveform diagram of example operation of the ripple suppression circuit, in accordance with embodiments of the present invention.

Referring now to FIG. 3, shown is a waveform diagram of example operation of the ripple suppression circuit, in accordance with embodiments of the present invention. Because the voltage at the positive terminal of LED load 3 is output voltage Vo with a ripple component, and the voltage $V_{LEDN}$ at the negative terminal is controlled to follow the ripple variation of output voltage Vo, the voltage between the two terminals of LED load 3 may be a DC voltage without ripple component; therefore, there is substantially no ripple component in the driving current ($I_{LED}$) of LED load 3.

By sampling the ripple component of the output voltage of the DC converter, ripple reference voltage Ripple_REF that represents the ripple component may be generated thereby. The voltage at the negative terminal of the LED load can be controlled to follow the variation of ripple reference voltage Ripple_REF by linear control of transistor Q2. Also, the voltage at the positive terminal of the LED load is output voltage Vo with the ripple component. Therefore, the voltage across LED load 3 can be controlled to be a DC voltage to suppress or eliminate the ripple component across LED load 3, in order to avoid the occurrence of flicker or stroboscopic effects of the LED load. In some implementations, the "first" or non-inverting input terminal of the error amplifier and the "second" or inverting input terminal can have reversed or exchanged signals provided thereto.

Figure 4:
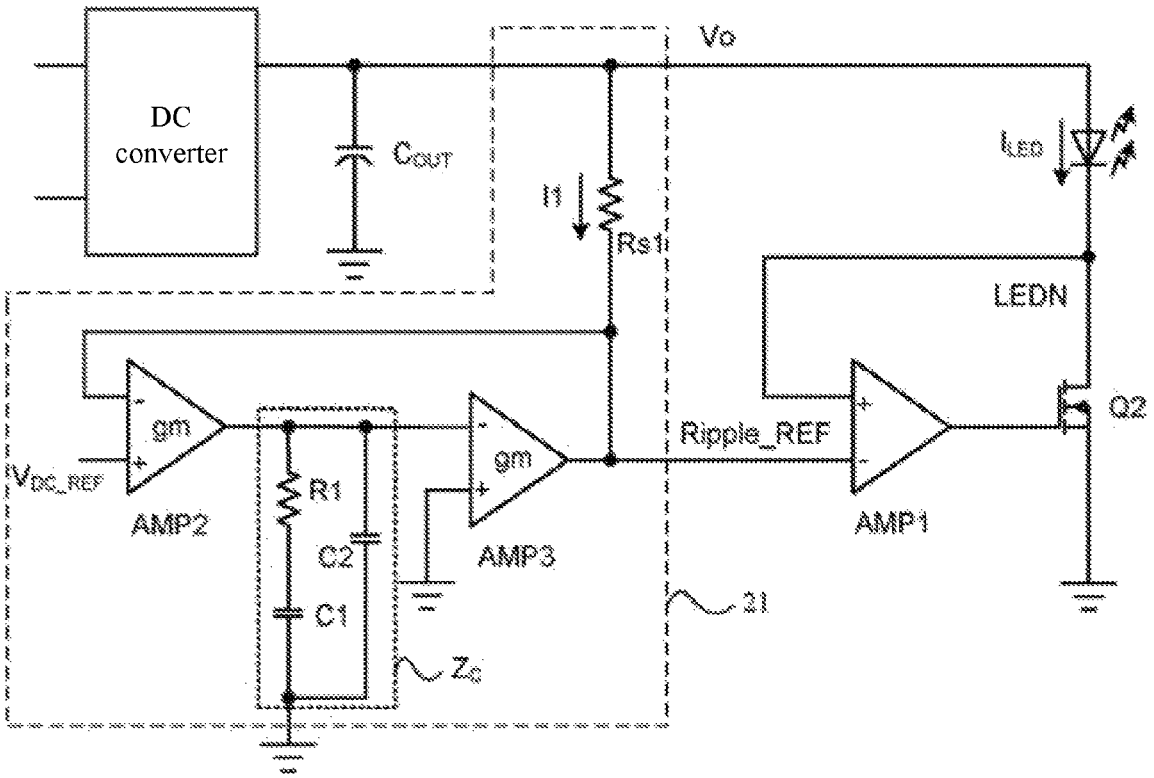
FIG. 4 is a schematic block diagram of another example LED driving circuit having a ripple suppression circuit, in accordance with embodiments of the present invention.

Referring now to FIG. 4, shown is a schematic block diagram of another example LED driving circuit having a ripple suppression circuit, in accordance with embodiments of the present invention. In this particular example, ripple voltage sampling circuit 21 of ripple suppression circuit can include sampling resistor Rs1, error amplifier AMP2, and compensation circuit Zc. Sampling resistor Rs1 can connect between output terminal of the DC converter and the output terminal of ripple voltage sampling circuit 21. The non-inverting input terminal of error amplifier AMP2 can receive DC reference voltage $V_{DC_REF}$, and the inverting input terminal is coupled to the output terminal of ripple voltage sampling circuit 21. The inverting input terminal of error amplifier AMP3 can connect to the output terminal of error amplifier AMP2, and the non-inverting input terminal can connect to ground, and the output terminal may be configured as the output terminal of ripple voltage sampling circuit 21.

Compensation circuit Zc can connect between the output terminal of error amplifier AMP2 and ground, and may compensate the output signal of error amplifier AMP2. For example, compensation circuit Zc can include resistor R1 and capacitor C1 connected in series between output terminal of error amplifier AMP2 and ground, and capacitor C2 connected between output terminal of error amplifier AMP2 and ground. For example, error amplifiers AMP2 and AMP3 may be configured as transconductance amplifiers, and may be used to convert the error between the two voltage signals at the two input terminals to a current signal that represents the error therebetween.

The error between ripple reference voltage Ripple_REF and DC reference voltage VDC_REF may be amplified and compensated by compensation circuit Zc in order to generate an error signal that represents an average value of the ripple component of output voltage Vo. Current I1 can be generated at the output terminal of error amplifier AMP3 by amplifying the error signal. Current I1 that flows through sampling resistor Rs1 may generate drop voltage ΔV. Therefore, ripple reference voltage Ripple_REF can be represented as the formula, Ripple_REF=Vo−ΔV. By predetermining the parameters of error amplifier AMP1, Zc, and AMP2, current I1 may be controlled to be a DC current; therefore, the voltage across resistor Rs1 can be controlled to be a DC voltage. Thus, ripple reference voltage Ripple_REF can represent ripple voltage information of output voltage Vo.

When ripple reference voltage Ripple_REF is greater than DC voltage $V_{DC_REF}$, the output current of error amplifier AMP2 may decrease in order to decrease the voltage of the compensation circuit. Thus, the output current of error amplifier AMP3 that flows through sampling resistor Rs1 may also increase. Because output voltage Vo is the sum of voltage across sampling resistor Rs1 and ripple reference voltage Ripple_REF, ripple reference voltage Ripple_REF can also be decreased. Through this control, the DC component of ripple reference voltage Ripple_REF can be controlled to be DC reference voltage $V_{DC_REF}$. Solving the small signal model to the AC components, following formula (1) may be concluded.

$$V_O^{\sim} - V_{Ripple_REF}^{\sim} = V_{Ripple_REF}^{\sim} \cdot gm_{AMP2} \cdot Z_C \cdot gm_{AMP3} \cdot Rs1 \quad (1)$$

Here, $V_O^{\sim}$ and $V_{Ripple_REF}^{\sim}$ may represent the AC components of output voltage Vo and ripple reference voltage Ripple_REF. Items "$gm_{AMP2}$" and "$gm_{AMP3}$" can represent the respective amplifying coefficient of error amplifiers AMP2 and AMP3, and "Zc" can represent the resistance of the compensation circuit. Therefore, the AC components of output voltage Vo and ripple reference voltage Ripple_REF can be represented as per the following formula (2).

$$V_{\widetilde{Ripple_REF}} = \frac{1}{1 + gm_{AMP1} \cdot Z_C \cdot gm_{AMP2} \cdot Rs1} V_{\widetilde{O}} \quad (2)$$

By predetermining parameters of error amplifier AMP1, Zc, and AMP2, the product $gm_{AMP1} \cdot Z_C \cdot gm_{AMP2} \cdot Rs1$ can be far less than 1. Therefore, the AC components of output voltage Vo and ripple reference voltage Ripple_REF may be controlled to be consistent with (e.g., the same as) each other. By the above implementation, ripple reference voltage Ripple_REF that represents the AC component of output voltage Vo and having a much smaller DC component can be generated. The drain voltage of transistor Q2 may be controlled to vary along with the AC component of output voltage Vo in accordance with ripple reference voltage Ripple_REF, in order to eliminate side effects to the LED load due to the AC components.

Figure 5:
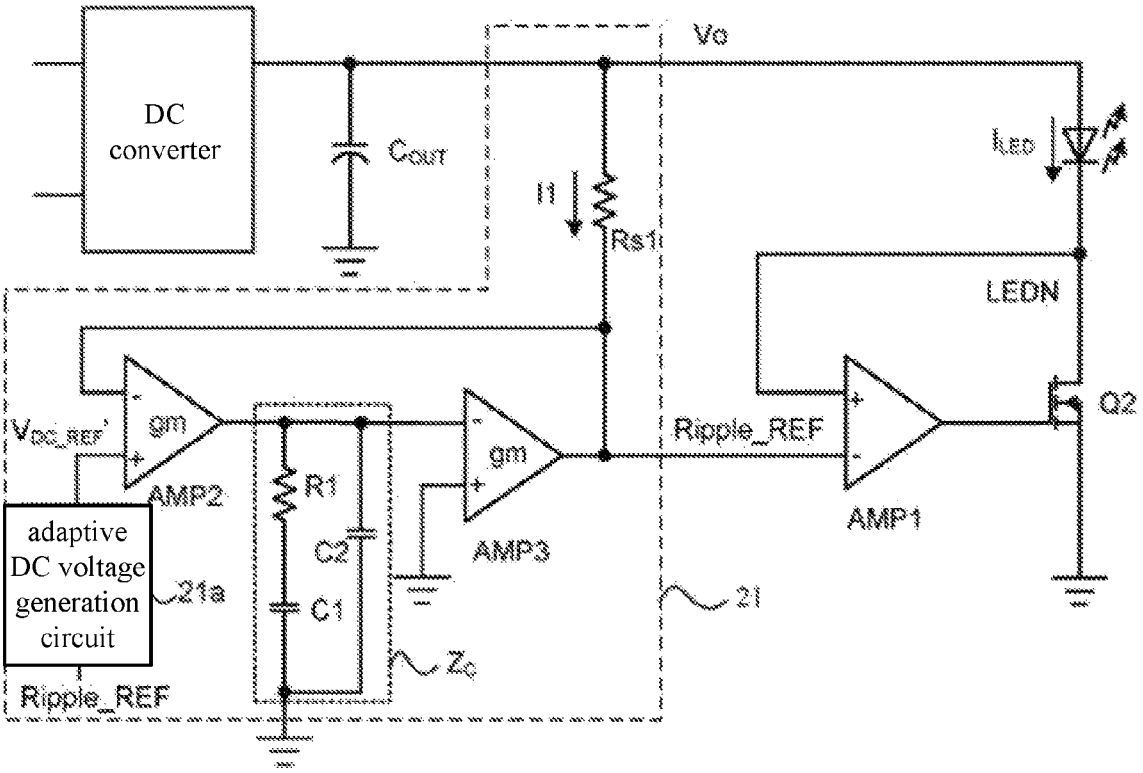
FIG. 5 is a schematic block diagram of yet another example LED driving circuit having a ripple suppression circuit, in accordance with embodiments of the present invention.

Referring now to FIG. 5, shown is a schematic block diagram of yet another example LED driving circuit having a ripple suppression circuit, in accordance with embodiments of the present invention. In this example, besides sampling resistor Rs, error amplifiers AMP2 and AMP3, and compensation circuit Zc, ripple voltage sampling circuit 21 can also include adaptive DC voltage generator 21*a* coupled between the output terminal of ripple voltage sampling circuit 21 and the non-inverting input terminal of error amplifier AMP2. Adaptive DC voltage generator 21*a* can regulate DC reference voltage $V_{DC_REF}'$ in accordance with ripple reference voltage Ripple_REF. For example, when the value of ripple reference voltage Ripple_REF increases, DC reference voltage $V_{DC_REF}'$ can be regulated to be correspondingly increased. When the value of ripple reference voltage Ripple_REF decreases, DC reference voltage $V_{DC_REF}'$ can be regulated to be correspondingly decreased. The DC component of ripple reference voltage Ripple_REF can be regulated by adaptive DC voltage generator 21*a* in order to maintain ripple reference voltage Ripple_REF to be a DC voltage signal with an average value as low as possible to decrease power losses.

Figure 6:
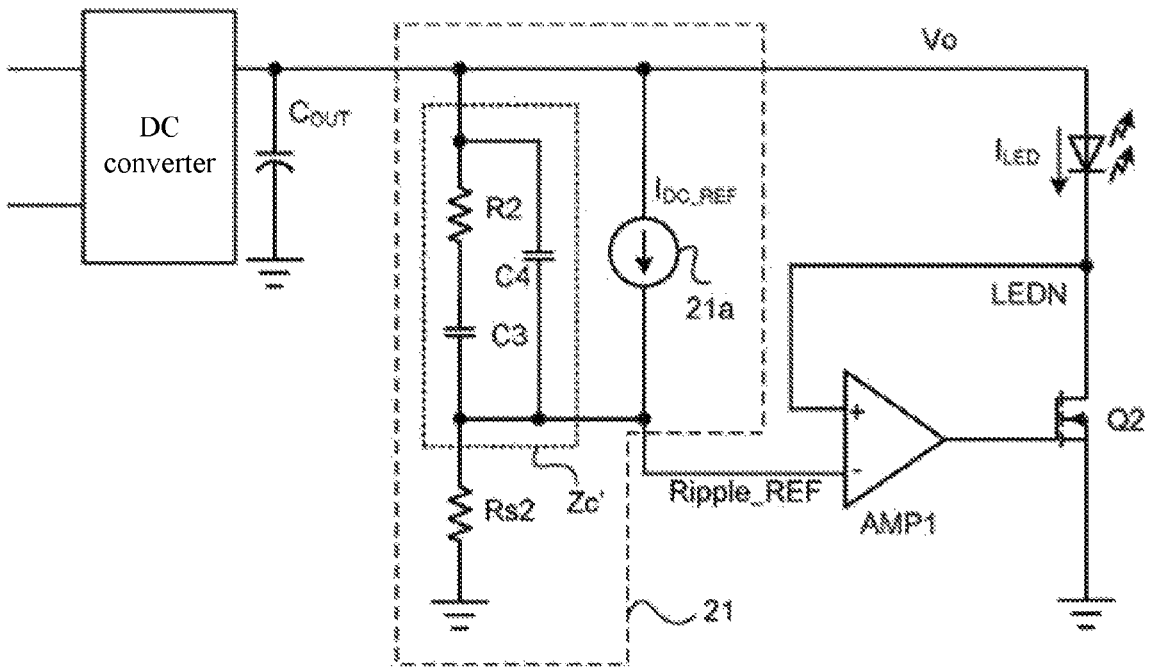
FIG. 6 is a schematic block diagram of still yet another example LED driving circuit having a ripple suppression circuit, in accordance with embodiments of the present invention.

Referring now to FIG. 6, shown is a schematic block diagram of still yet another example LED driving circuit having a ripple suppression circuit, in accordance with embodiments of the present invention. In this particular example, ripple voltage sampling circuit 21 of the ripple suppression circuit can include sampling resistor Rs2, compensation circuit Zc', and DC current source 21*a*. Compensation circuit Zc' and sampling resistor Rs2 can connect in series between the output terminal of the DC converter and ground. Compensation circuit Zc' can remove the DC component of the output voltage Vo. For example, compensation circuit Zc' can include resistor R2 and capacitor C3 coupled in series between the positive output terminal of DC converter and a first terminal of sampling resistor Rs2, and the second terminal of sampling resistor Rs2 can connect to ground. Compensation circuit Zc' can also include capacitor C4 coupled between the positive output terminal of DC converter and one terminal of sampling resistor Rs2.

DC current source 21*a* can connect in parallel with compensation circuit Zc', and may generate DC reference current IDc_REF. By the filtering performance of the capacitors of compensation circuit Zc', only the ripple signal (the AC component) of output voltage Vo may be transferred to sampling resistor Rs2 through compensation circuit Zc'. Thus an AC voltage signal that represents the AC component can be generated across sampling resistor Rs2. Also, the output current of DC current source 21*a* that flows through sampling resistor Rs2 can increase the AC voltage signal by a predetermined value. The voltage signal across sampling resistor Rs2 may be configured as ripple reference voltage Ripple_REF.

The first input terminal of error amplifier AMP1 can receive ripple reference voltage Ripple_REF, and the second input terminal can receive voltage $V_{LEDN}$ at the common node (e.g., the drain voltage of transistor Q2) of LED load and transistor Q2. The gate of transistor Q2 can be controlled by the output signal of error amplifier AMP1 to control transistor Q2 to operate in a linear mode. By the feedback loop of error amplifier AMP1 and transistor Q2, source voltage $V_{LEDN}$ of transistor Q2 can be controlled to be consistent with (e.g., the same as) ripple reference voltage Ripple_REF, which is also consistent with the AC component of output voltage Vo. Therefore, the voltage across the LED load can be a DC voltage signal without an AC component, and no ripple component may flow through the LED load. In this way, the number of error amplifiers can be decreased as compared to other approaches.

Figure 7:
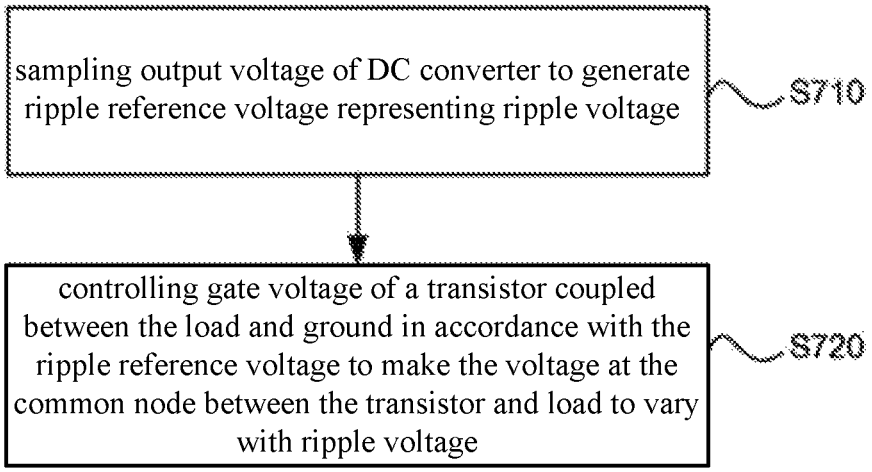
FIG. 7 is a flow diagram of an example ripple suppression method, in accordance with embodiments of the present invention.

Referring now to FIG. 7, shown is a flow diagram of an example ripple suppression method, in accordance with embodiments of the present invention. This particular ripple suppression method can include, at S710, sampling the output voltage of a DC converter to generate a ripple reference voltage that represents the ripple component of the output voltage. This example ripple suppression method can also include, at S720, controlling the voltage at the gate terminal of a transistor coupled between the LED load and ground, in order to maintain the voltage at the common node of the LED load and the transistor to be consistent with the ripple component of the output voltage.

In this fashion, a ripple reference voltage that represents the ripple component of the output voltage can be generated by sampling the output voltage of a DC converter. The voltage at the negative terminal of the LED load can be controlled to be consistent with (e.g., the same as) the ripple component by control of a transistor coupled between the negative terminal of the LED load and ground. Because the ripple component of the output voltage at the positive terminal of the LED load is consistent with the voltage at the negative terminals of the LED load, the voltage across the LED load can be a DC voltage without a ripple component in order to eliminate the flicker or stroboscopic effects of the LED load.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A ripple suppression circuit configured to suppress a current ripple provided to a load by a DC converter, the ripple suppression circuit comprising:

a) a ripple voltage sampling circuit coupled to output terminals of said DC converter, wherein said ripple voltage sampling circuit is configured to generate a ripple reference voltage that represents a ripple voltage of an output voltage of said DC converter; and b) a voltage regulation circuit coupled to said load and said ripple voltage sampling circuit, wherein said voltage regulation circuit is controllable by said ripple reference voltage such that a voltage across said voltage regulation circuit is consistent with said ripple voltage.

2. The ripple suppression circuit of claim 1, wherein said load and said voltage regulation circuit are coupled in series between said output terminals of said DC converter, and wherein one of said output terminals is coupled to ground.

3. The ripple suppression circuit of claim 2, wherein said voltage regulation circuit comprises:

a) a transistor coupled between said load and ground; and b) a driving circuit configured to drive said transistor in accordance with said ripple reference voltage to control a voltage at a common node between said transistor and said load to be consistent with said ripple voltage.

4. The ripple suppression circuit of claim 3, wherein said transistor is controlled to operate in a linear mode.

5. The ripple suppression circuit of claim 3, wherein said driving circuit comprises a first error amplifier having a first input terminal coupled to said common node, a second input terminal configured to receive said ripple reference voltage, and an output terminal coupled to a gate of said transistor.

6. The ripple suppression circuit of claim 1, wherein said ripple voltage sampling circuit comprises:

a) a removing circuit coupled to said output terminals of said DC converter, wherein said removing circuit is configured to remove a DC voltage component of said output voltage of said DC converter; and b) a sampling resistor coupled between one of said output terminals of said DC converter and said removing circuit, wherein a voltage at a common node between said sampling resistor and said removing circuit configured as said ripple reference voltage.

7. The ripple suppression circuit of claim 6, wherein one terminal of said sampling resistor is coupled between a positive output terminal of said DC converter, and said removing circuit comprises:

a) a second error amplifier having a first input terminal configured to receive a DC reference voltage, and a second input terminal coupled to said sampling resistor;

b) a first compensation circuit coupled between an output terminal of said second error amplifier and ground, wherein said first compensation circuit is configured to compensate an output signal of said second error amplifier; and c) a third error amplifier having a first input terminal coupled to ground, a second input terminal coupled to said output terminal of said second error amplifier, and an output terminal coupled to said sampling resistor.

8. The ripple suppression circuit of claim 7, wherein said DC reference voltage is a constant voltage.

9. The ripple suppression circuit of claim 7, wherein said ripple voltage sampling circuit further comprises an adaptive DC voltage generation circuit coupled between said output terminal of said ripple voltage sampling circuit and said first input terminal of said second error amplifier, wherein said adaptive DC voltage generating circuit is configured to regulate said DC reference voltage in accordance with said ripple reference voltage.

10. The ripple suppression circuit of claim 9, wherein:

a) said DC reference voltage is correspondingly increased when said ripple reference voltage increases; and b) said DC reference voltage is correspondingly decreased when said ripple reference voltage decreases.

11. The ripple suppression circuit of claim 7, wherein said first compensation circuit comprises:

a) a compensation sub-circuit having a first resistor and a first capacitor coupled in series; and b) a second capacitor coupled in parallel with said compensation sub-circuit.

12. The ripple suppression circuit of claim 6, wherein one terminal of said sampling resistor is coupled between a negative output terminal of said DC converter, and said removing circuit comprises a second compensation circuit coupled between a positive output terminal of said DC converter and said sampling resistor, and being configured to remove a DC voltage component of said output voltage of said DC converter.

13. The ripple suppression circuit of claim 12, wherein said removing circuit further comprises a DC current source coupled in parallel with said compensation circuit, and being configured to generate DC reference current.

14. The ripple suppression circuit of claim 12, wherein said second compensation circuit comprises:

a) a compensation sub-circuit having a second resistor and a third capacitor coupled in series; and b) a fourth capacitor coupled in parallel with said compensation sub-circuit.

15. The ripple suppression circuit of claim 1, wherein said DC converter comprises one of an AC-DC power converter and a DC-DC power converter.

16. A light-emitting diode (LED) lighting apparatus, comprising:

a) a DC converter configured to generate an output voltage, wherein said DC converter is one of an AC-DC power converter and a DC-DC power converter;

b) an LED load coupled to output terminals of said DC converter; and c) said ripple suppression circuit of claim 1.

17. A ripple suppression method configured to suppress a current ripple provided to a load by a DC converter, the method comprising:

a) generating a ripple reference voltage representing a ripple voltage of an output voltage of said DC converter; and b) controlling a voltage across a voltage regulation circuit coupled in series with said load between said output terminals of said DC converter to be consistent with said ripple voltage in accordance with said ripple reference voltage.

18. The method of claim 17, further comprising controlling a gate voltage of a transistor coupled between said load and ground in accordance with said ripple reference voltage to control a voltage at a common node of said transistor and said load to be consistent with said ripple voltage.

19. The method of claim 17, further comprising:

a) removing, by a removing circuit, a DC voltage component of said output voltage of said DC converter;

b) controlling a voltage across a sampling resistor with one terminal coupled to positive output terminal of said DC converter to be consistent with said DC voltage of said output voltage of said DC converter in accordance with an output signal of said removing circuit; and c) configuring the voltage at the other terminal of said sampling resistor to be said ripple reference voltage.

20. The method of claim 17, further comprising:

a) removing said DC voltage component of said output voltage of said DC converter by a removing circuit coupled between positive output terminal of said DC converter and a first terminal of a sampling resistor; and b) configuring a voltage across said sampling resistor with a second terminal coupled to negative output terminal of said DC converter to be said ripple reference voltage.

* * * * *